US008166849B2

(12) United States Patent
Chan

(10) Patent No.: US 8,166,849 B2
(45) Date of Patent: May 1, 2012

(54) COMBINATION RATCHETING WRENCH WITH A BOX-END WRENCH HAVING AN OPENING

(76) Inventor: Shu-Su Chan, Changhua (TW)

( * ) Notice: Subject to any disclaimer, the term of this patent is extended or adjusted under 35 U.S.C. 154(b) by 351 days.

(21) Appl. No.: 12/638,995

(22) Filed: Dec. 16, 2009

(65) Prior Publication Data

US 2011/0138971 A1 Jun. 16, 2011

(51) Int. Cl.
*B25B 13/08* (2006.01)
*B25B 13/46* (2006.01)

(52) U.S. Cl. ..... 81/58.2; 81/60

(58) Field of Classification Search ..... 81/58.2, 81/60, 61
See application file for complete search history.

(56) References Cited

U.S. PATENT DOCUMENTS 4,807,500 A * 2/1989 Main ..... 81/63.1
4,926,720 A * 5/1990 Srzanna ..... 81/61
5,392,672 A * 2/1995 Larson et al. ..... 81/60
6,446,530 B1 * 9/2002 Chang ..... 81/60
7,185,564 B2 * 3/2007 Hsien ..... 81/60
2003/0213342 A1 * 11/2003 Wu ..... 81/60
2006/0027049 A1 * 2/2006 Arnold ..... 81/60
2007/0044593 A1 * 3/2007 Murdoch ..... 81/58.2
2009/0193939 A1 * 8/2009 Chiu et al. ..... 81/60
2010/0257979 A1 * 10/2010 Zhan ..... 81/58.2
2011/0094348 A1 * 4/2011 Lee et al. ..... 81/58.2
2011/0113930 A1 * 5/2011 Liao ..... 81/58.2

* cited by examiner

*Primary Examiner* — David B Thomas

(57) ABSTRACT

A combination open-ended ratcheting wrench with a box-end wrench has a wrench having a wrench head, the wrench head having a first aperture with a first opening, a receptacle formed at an inner wall of the first aperture, at least one limiting groove disposed around the inner wall of the first aperture; a control member pushing against an elastic member acceptable in the receptacle and having a ratcheting surface and a smooth surface, and at least one stopping edge corresponding to and accepting the limiting members; a ratchet disposed in the first aperture and having a ratcheting aperture, the ratcheting aperture having a ratchet opening, a ratcheting pawl formed around an outer circumference of the ratchet and corresponding to the ratcheting surface of the control member; and a rotation cap disposed on the wrench head covering a portion of the ratchet in the first aperture and having a second opening.

16 Claims, 8 Drawing Sheets

COMBINATION RATCHETING WRENCH WITH A BOX-END WRENCH HAVING AN OPENING

BACKGROUND OF THE INVENTION

1. Field of the Invention

The present invention relates to a combination ratcheting wrench having an opening with a box-end wrench, which is a manual tool that offers improved freedom of usage.

2. Description of the Related Art

Manual tools are very important for assembly purposes, mechanics, in construction, etc. Taking wrenches as an example, an open-ended wrench can still be used when the locking member (i.e., bolt or nut) is obstructed. This type of wrench often requires users to repeatedly remove the wrench from the locking member, and then reconnect the wrench to the locking member to apply a torque. Accordingly, the ratchet wrench was developed; the ratchet wrench can only be operated in one direction, and the user can continuously turn the ratchet wrench without separating the ratchet wrench from the screw locking member. Therefore, the ratchet wrench can be used to continuously apply a force to the screw locking member in the same direction, which dramatically increases the convenience for the user. However, for some working environments, such as the installation of air conditioners, the screw locking member may be located at the end of wire, and thus requires an open-ended wrench for disassembly/assembly purposes.

Therefore, it is desirable to provide a combination open-ended ratcheting wrench with a box-end wrench, to mitigate and/or obviate the aforementioned problems.

SUMMARY OF THE INVENTION

An objective of the present invention is to provide a combination open-ended ratcheting wrench with a box-end wrench, which is a manual tool that offers more freedom of usage.

A combination ratcheting open-ended wrench with a box-end wrench comprises a wrench, a control member, a ratchet and a rotation cap. The wrench has a wrench head, and the wrench head has a first aperture with a first opening, a receptacle formed on an inner wall of the first aperture, and two limiting grooves disposed around the inner wall of the first aperture and connected to the receptacle, the limiting grooves having internal limiting members. The limiting members are C-shaped rings. The first aperture further has a first assembling groove and a second assembling groove respectively disposed on both outer sides of the two limiting grooves. The control member pushes against an elastic member acceptable in the receptacle and has a ratcheting surface and a smooth surface, both of which face outwards, and two stopping edges that correspond to and accept the limiting members. The elastic member is a circular spring, a sheet spring, or is formed of rubber. The receptacle further includes a first hole disposed in the bottom surface, and the control member has a second hole facing the receptacle such that the elastic member is placed in the first hole and the second hole to provide a limiting effect. The ratchet is disposed in the first aperture and has a ratcheting aperture, and a stopping ring at an enlarged end, and a roughened surface is formed along an outer edge of the stopping ring. The ratcheting aperture has a ratchet opening, and a ratcheting pawl is formed around an outer circumference of the ratchet and corresponds to the ratcheting surface of the control member. The ratchet has a first positioning groove adjacent to the ratcheting pawl corresponding to the first assembling groove, and a first C-shaped hook is sandwiched between the first assembling groove and the first positioning groove such that the ratchet is capable of rotating in the wrench head. The rotation cap disposed on the wrench head covers a portion of the ratchet in the first aperture and has a second opening corresponding to the first aperture. The rotation cap further comprises a second positioning groove corresponding to the second assembling groove, and a second C-shaped hook is sandwiched between the second assembling groove and the second positioning groove such that the rotation cap is capable of rotating in the wrench head. The rotation cap has a flanged portion as a larger end and a connecting end as a smaller end. The rotation cap has a roughened edge around the circumference of the flanged portion. The connecting end is jacketed onto an end of the ratcheting pawl of the ratchet and has a coupling segment extending from an inner wall of the connecting end. The coupling segment matches a corresponding coupling beveled corner formed at the end of the ratcheting pawl, such that the rotation cap is coupled to the ratchet.

The control member is installed in the receptacle through the first aperture of the wrench, and the elastic member is sandwiched between the surface of the receptacle and the control member; the elastic member pushes the control member outwardly. The two limiting members are installed in both limiting grooves in the first aperture, and the limiting members are compressed in the limiting grooves and generate expanding outward tension. The limiting members respectively push against the two the stopping edges of the control member to hold the control member in the receptacle and prevent the control member from being ejected by the elastic member. The ratchet has the first C-shaped hook compressed in the first positioning groove, and the ratchet is placed in the first aperture with the ratcheting pawl towards the first assembling groove. With the first C-shaped hook being engaged with the first assembling groove, the ratchet and wrench are limited with respect to each other, such that only the ratchet is able to be rotated. The rotation cap has the second C-shaped hook compressed in the second positioning groove, and the rotation cap is placed in the first aperture with the connecting end. With the second C-shaped hook being engaged with the second assembling groove, the rotation cap and the wrench are limited with respect to each other, such that only the rotation cap is able to be rotated. The connecting end of the rotation cap is jacketed onto the end of the ratcheting pawl, and the coupling segment of the connecting end corresponds to the coupling bevel of the ratchet to provide the coupled relationship between the rotation cap and the ratchet.

With the above-mention structure, the wrench has the first opening at the wrench head, the ratchet has the ratchet opening, so combination open-ended ratcheting wrench with a box-end wrench can work on the screw locking member. Furthermore, with the relationship between the control member and the ratchet, the wrench has the rotatable ratchet and an opening, which offers improved freedom of usage.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
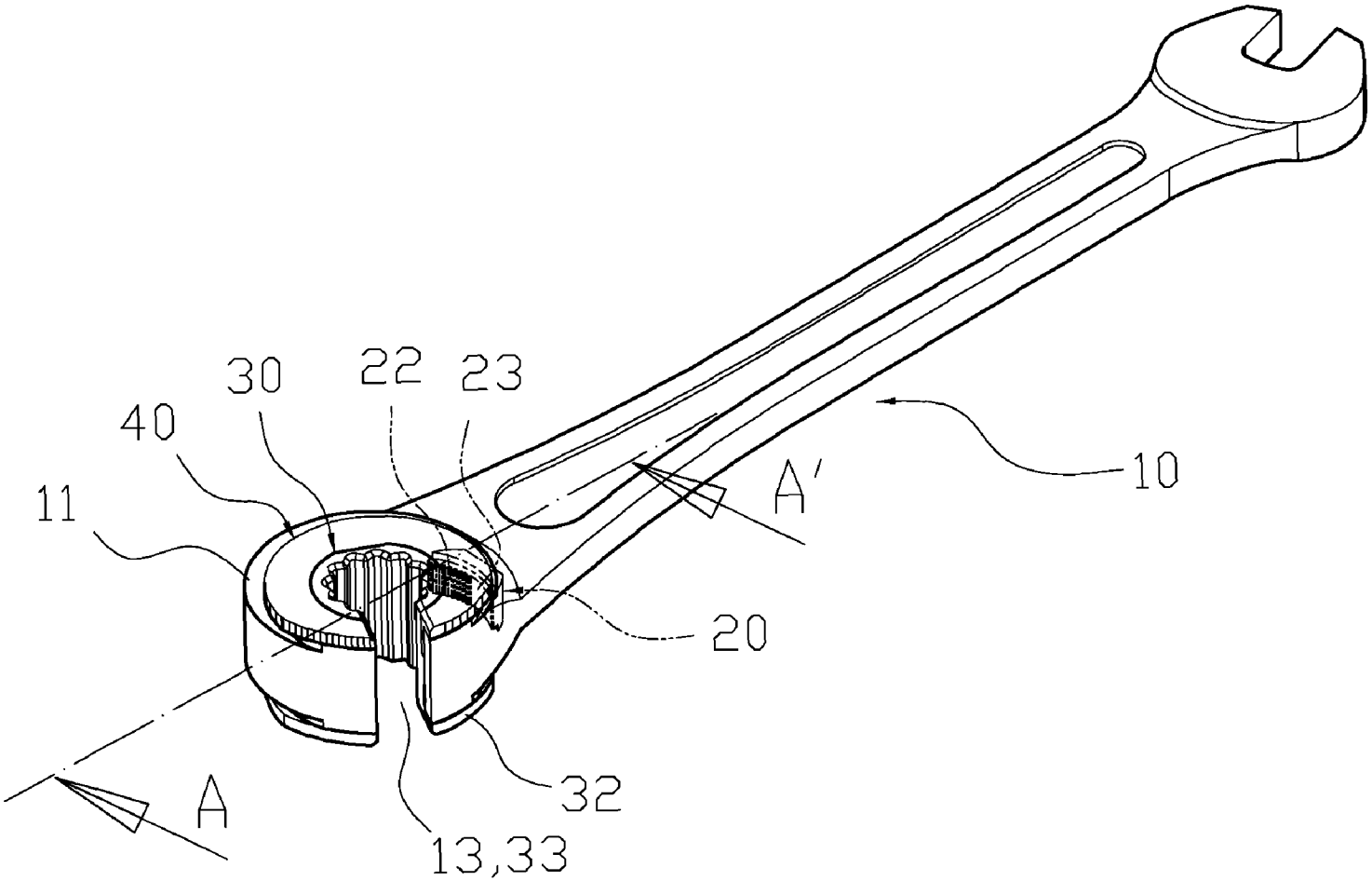
FIG. 1 is a perspective view of an embodiment of the present invention.
Figure 2:
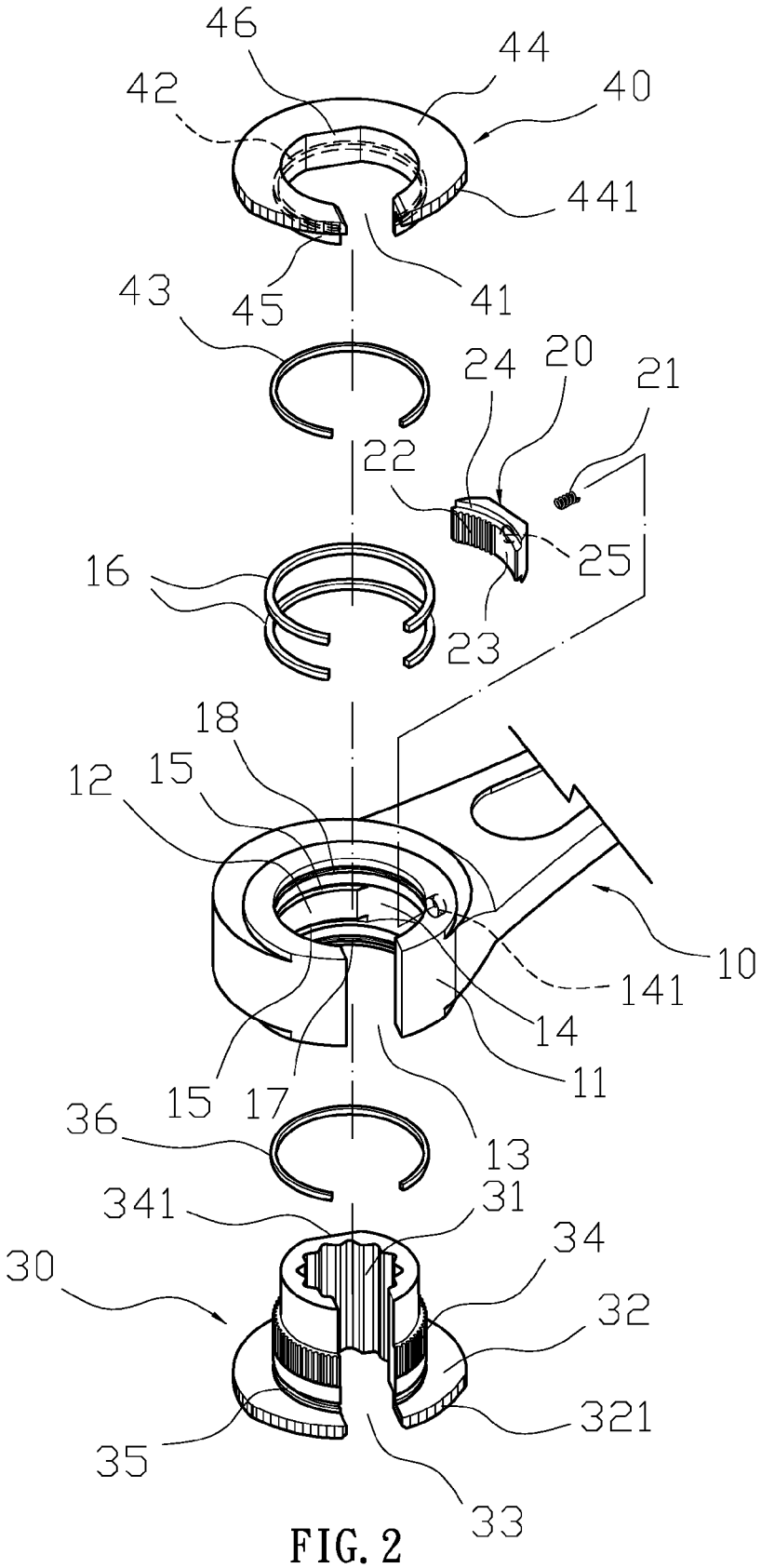
FIG. 2 is a perspective exploded view of an embodiment of the present invention.

Please refer to FIG. 1 and FIG. 2. A combination open-ended ratcheting wrench with a box-end wrench comprises a wrench 10, a control member 20, a ratchet 30 and a rotation cap 40. The wrench 10 has a wrench head 11, and the wrench head 11 has a first aperture 12 with a first opening 13, a receptacle 14 formed on an inner wall of the first aperture 12, and two limiting grooves 15 disposed around the inner wall of the first aperture 12 and connected to the receptacle 14, the limiting grooves 15 having internal limiting members 16. The limiting members 16 are C-shaped rings. The first aperture 12 further has a first assembling groove 17 and a second assembling groove 18 respectively disposed on both outer sides of the two limiting grooves 15. The control member 20 pushes against an elastic member 21 acceptable in the receptacle 14 and has a ratcheting surface 22 and a smooth surface 23, both of which face outwards, and two stopping edges 24 that correspond to and accept the limiting members 16. The elastic member 21 is a circular spring, a sheet spring, or is formed of rubber. The receptacle further includes a first hole 141 disposed in the bottom surface, and the control member 20 has a second hole 25 facing the receptacle 14 such that the elastic member 21 is placed in the first hole 14 and the second hole 25 to provide a limiting effect. The ratchet 30 is disposed in the first aperture 12 and has a ratcheting aperture 31, and a stopping ring 32 at an enlarged end, and a roughened surface 321 is formed along an outer edge of the stopping ring 32. The ratcheting aperture 31 has a ratchet opening 33, and a ratcheting pawl 34 is formed around an outer circumference of the ratchet 33 and corresponds to the ratcheting surface 22 of the control member 20. The ratchet 30 has a first positioning groove 35 adjacent to the ratcheting pawl 34 corresponding to the first assembling groove 17, and a first C-shaped hook 36 is sandwiched between the first assembling groove 17 and the first positioning groove 35 such that the ratchet 30 is capable of rotating in the wrench head 11. The rotation cap 40 disposed on the wrench head 21 covers a portion of the ratchet 30 in the first aperture 12 and has a second opening 41 corresponding to the first aperture 12. The rotation cap 40 further comprises a second positioning groove 42 corresponding to the second assembling groove 18, and a second C-shaped hook 43 is sandwiched between the second assembling groove 18 and the second positioning groove 42 such that the rotation cap 40 is capable of rotating in the wrench head 11. The rotation cap 40 has a flanged portion 44 as a larger end and a connecting end 45 as a smaller end. The rotation cap 40 has a roughened edge 441 around the circumference of the flanged portion 44. The connecting end 45 is jacketed onto an end of the ratcheting pawl 34 of the ratchet 30 and has a coupling segment 46 extending from an inner wall of the connecting end 45. The coupling segment matches a corresponding coupling beveled corner 341 formed at the end of the ratcheting pawl 34, such that the rotation cap 40 is coupled to the ratchet 30.

Figure 3:
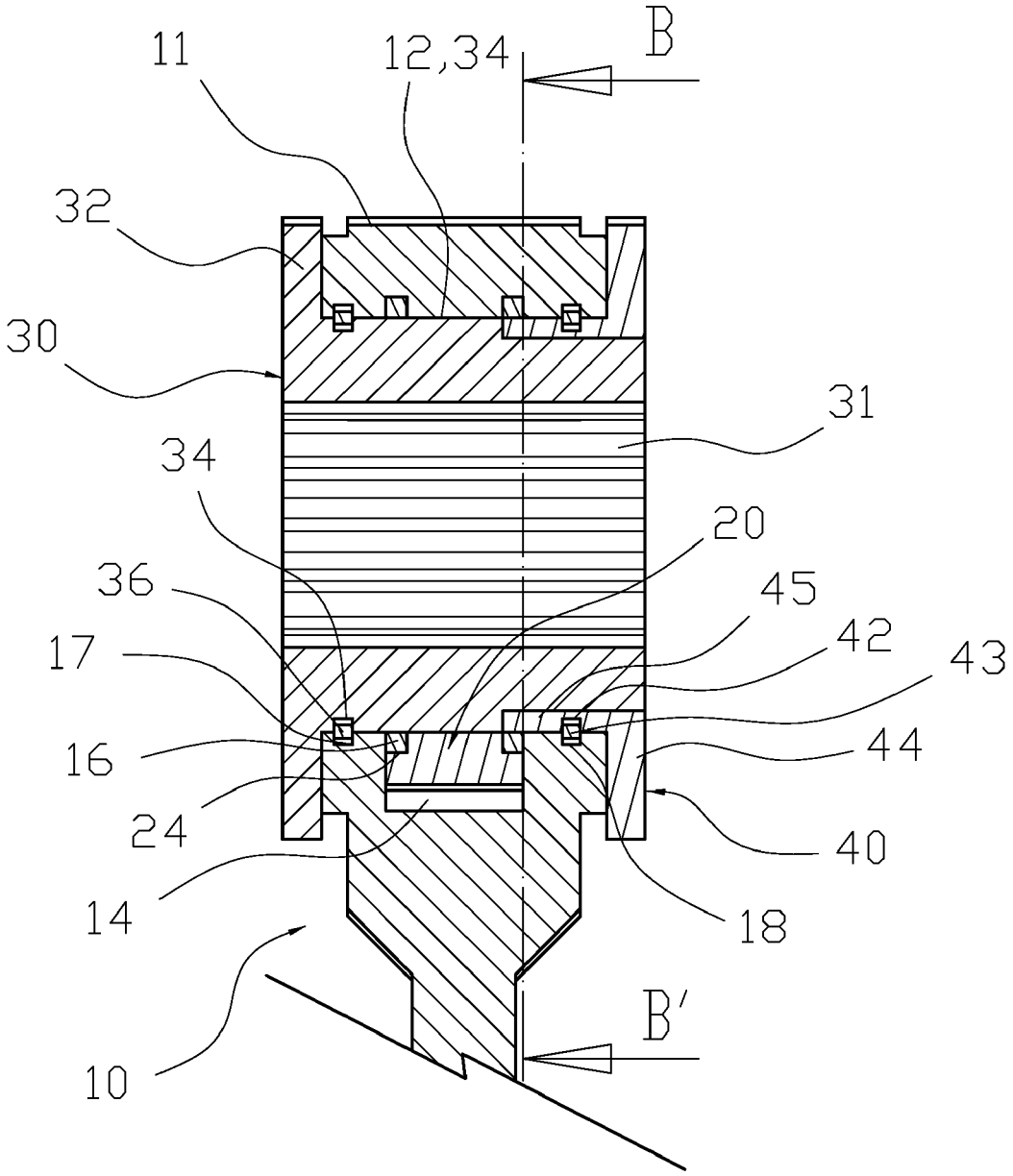
FIG. 3 is a cross-sectional side view along line B-B' shown in FIG. 1 according to an embodiment of the present invention.
Figure 4:
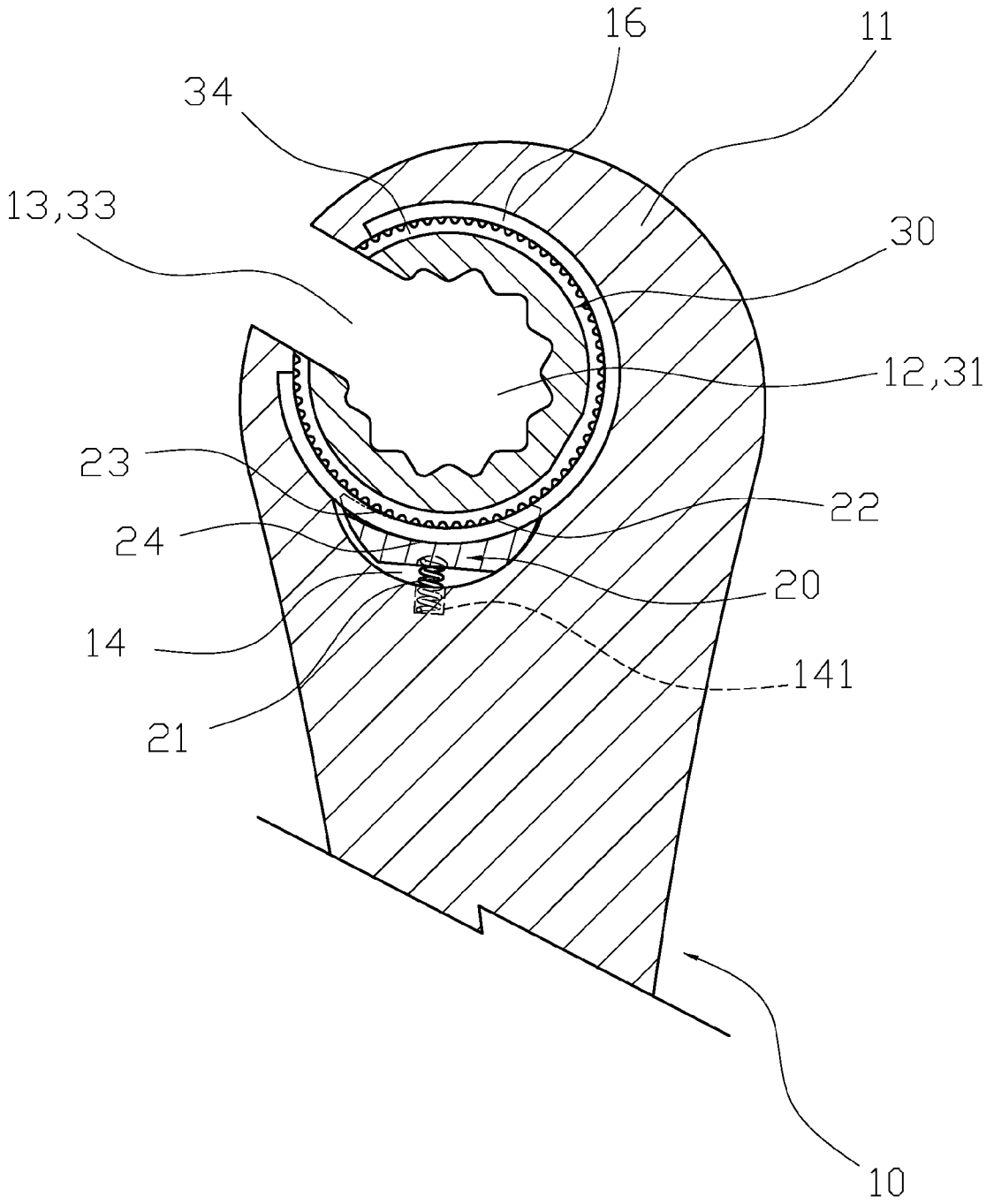
FIG. 4 is a cross-sectional view along B-B' line shown in FIG. 1 according to an embodiment of the present invention.

For the combined structure, please refer to FIGS. 2 to 4. The control member 20 is installed in the receptacle 14 through the first aperture 12 of the wrench 10, and the elastic member 21 is sandwiched between the surface of the receptacle 14 and the control member 20; the elastic member 21 pushes the control member 20 outwardly. The two limiting members 16 are installed in both limiting grooves 15 in the first aperture 12, and the limiting members 16 are compressed in the limiting grooves 15 and generate expanding outward tension. The limiting members 16 respectively push against the two the stopping edges 24 of the control member 20 to hold the control member 20 in the receptacle 14 and prevent the control member 20 from being ejected by the elastic member 21. The ratchet 30 has the first C-shaped hook 36 compressed in the first positioning groove 35, and the ratchet 30 is placed in the first aperture 12 with the ratcheting pawl 34 towards the first assembling groove 17. With the first C-shaped hook 36 being engaged with the first assembling groove 17, the ratchet 30 and wrench 10 are limited with respect to each other, such that only the ratchet 30 is able to be rotated. The rotation cap 40 has the second C-shaped hook 43 compressed in the second positioning groove 42, and the rotation cap 40 is placed in the first aperture 12 with the connecting end 45. With the second C-shaped hook 43 being engaged with the second assembling groove 18, the rotation cap 40 and the wrench 10 are limited with respect to each other, such that only the rotation cap 40 is able to be rotated. The connecting end 45 of the rotation cap 40 is jacketed onto the end of the ratcheting pawl 34, and the coupling segment 46 of the connecting end 45 corresponds to the coupling bevel 341 of the ratchet 30 to provide the coupled relationship between the rotation cap 40 and the ratchet 30.

Figure 5:
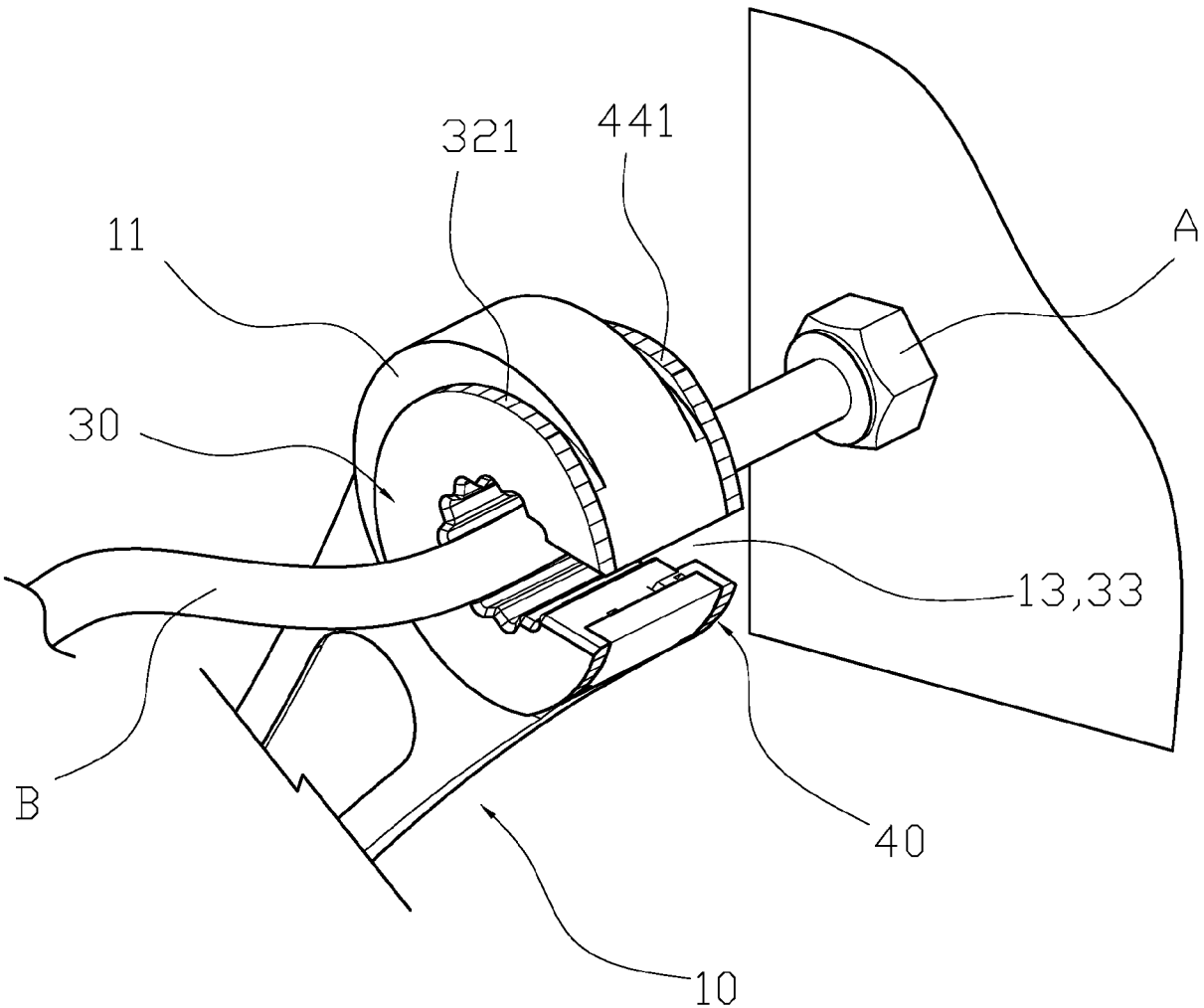
FIG. 5 is a schematic drawing of an embodiment of the present invention.
Figure 6:
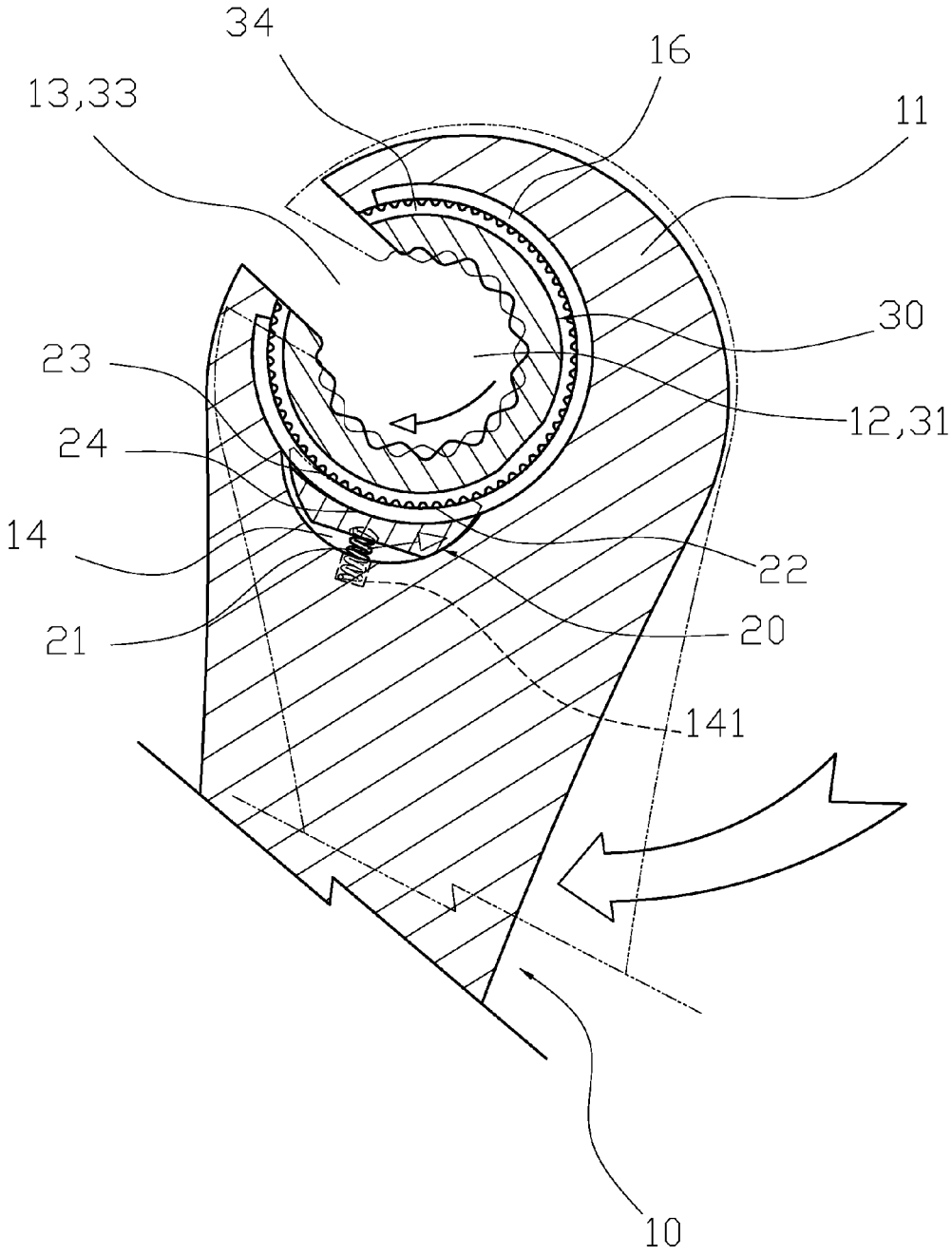
FIG. 6 is a schematic drawing of a wrench being rotated clockwise according to an embodiment of the present invention.
Figure 7:
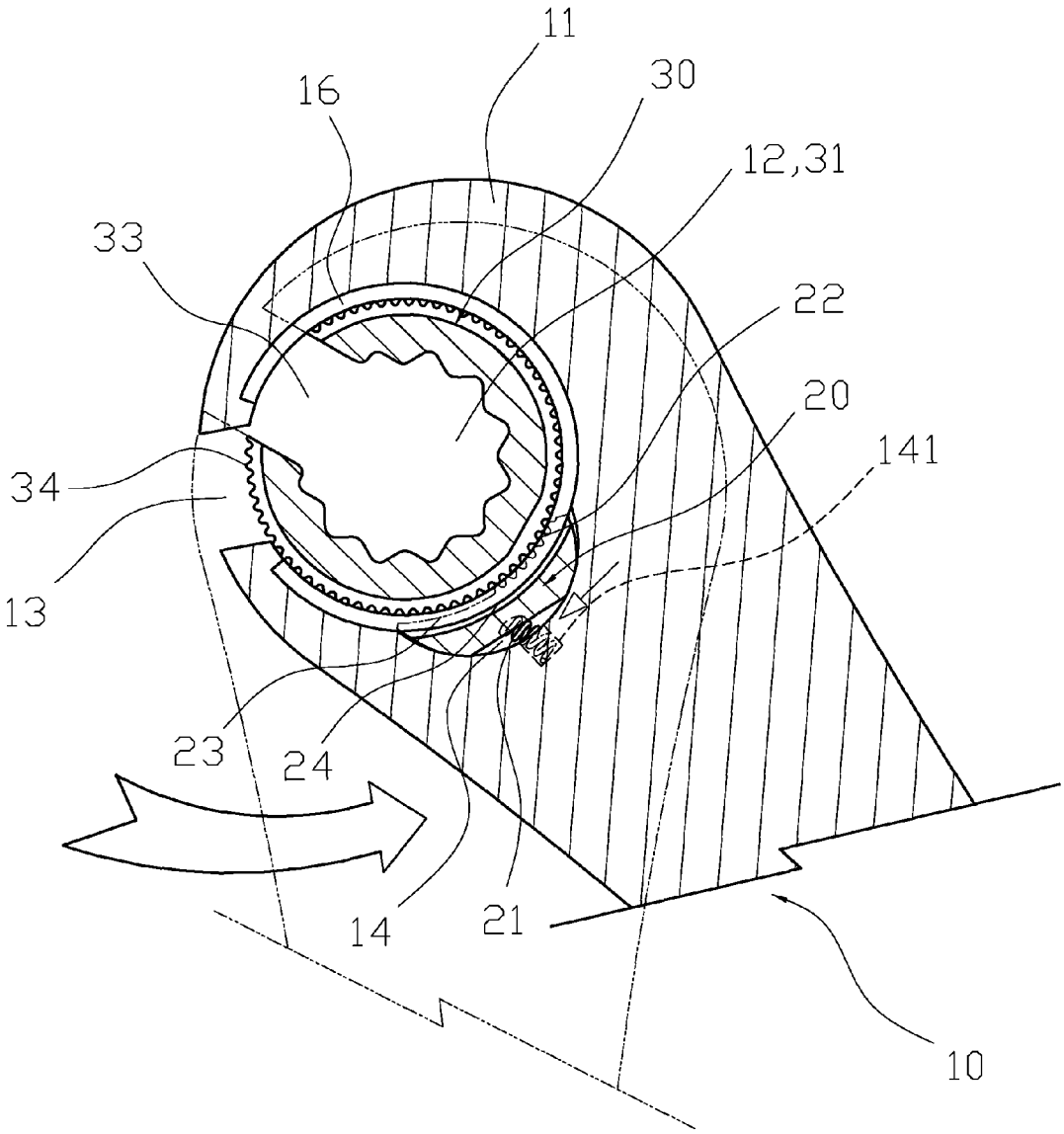
FIG. 7 is a schematic drawing of a wrench being rotated counterclockwise according to an embodiment of the present invention.

For actual operations, please refer to FIG. 5. A screw locking member A is locked at the end of a wire B. When the ratchet opening 33 of the wrench head 11 of the wrench 10 is jacketed onto the wire B, the wrench 10 is able to tighten or loosen the screw locking member A without breaking or cutting of the wire B. Please refer to FIGS. 6 and 7 with FIG. 2. When the wrench 10 is rotated clockwise, the ratchet aperture 31 of the ratchet 30 is blocked by the screw locking member A and generates an opposite force to the wrench 10, while the ratcheting surface 22 of the control member 20 is pushed by the ratcheting pawl 34 of the ratchet 30 to cause the control member 20 to generate movement towards the ratcheting surface 22. Meanwhile, the ratchet 30 and the wrench 10 are compressed by the control member 20 and locked with each other, such that the ratchet 30 is able to drive the screw locking member A to be locked tight. On the other hand, when the wrench 10 is rotated counterclockwise, the ratchet 30 is blocked by the screw locking member A and generates an opposite force to the wrench 10 to cause the control member 20 to generate movement towards the smooth surface 23. Since the smooth surface 23 is not able to drive the ratchet 30, and the ratcheting surface 22 and the ratcheting pawl 34 are separated, the ratchet 30 cannot be simultaneously rotated with the wrench 10, the wrench 10 is reset after the locking movement. In order to remove the wrench 10, the flanged portion 44 of the rotation cap 40 or the stopping ring 32 of the ratchet 30 is rotated to cause the ratchet opening 33 of the ratchet 30 to align with the first opening 13. Therefore, the first opening 13, the ratchet opening 33 and the second opening 41, which are all same sized openings, all align with one another before being used and after being used. However, in operations, the limiting members 16 push against the stopping edge 24 of the control member 20 to prevent the control member 20 from being ejected from the receptacle 14 for better stability.

Figure 8:
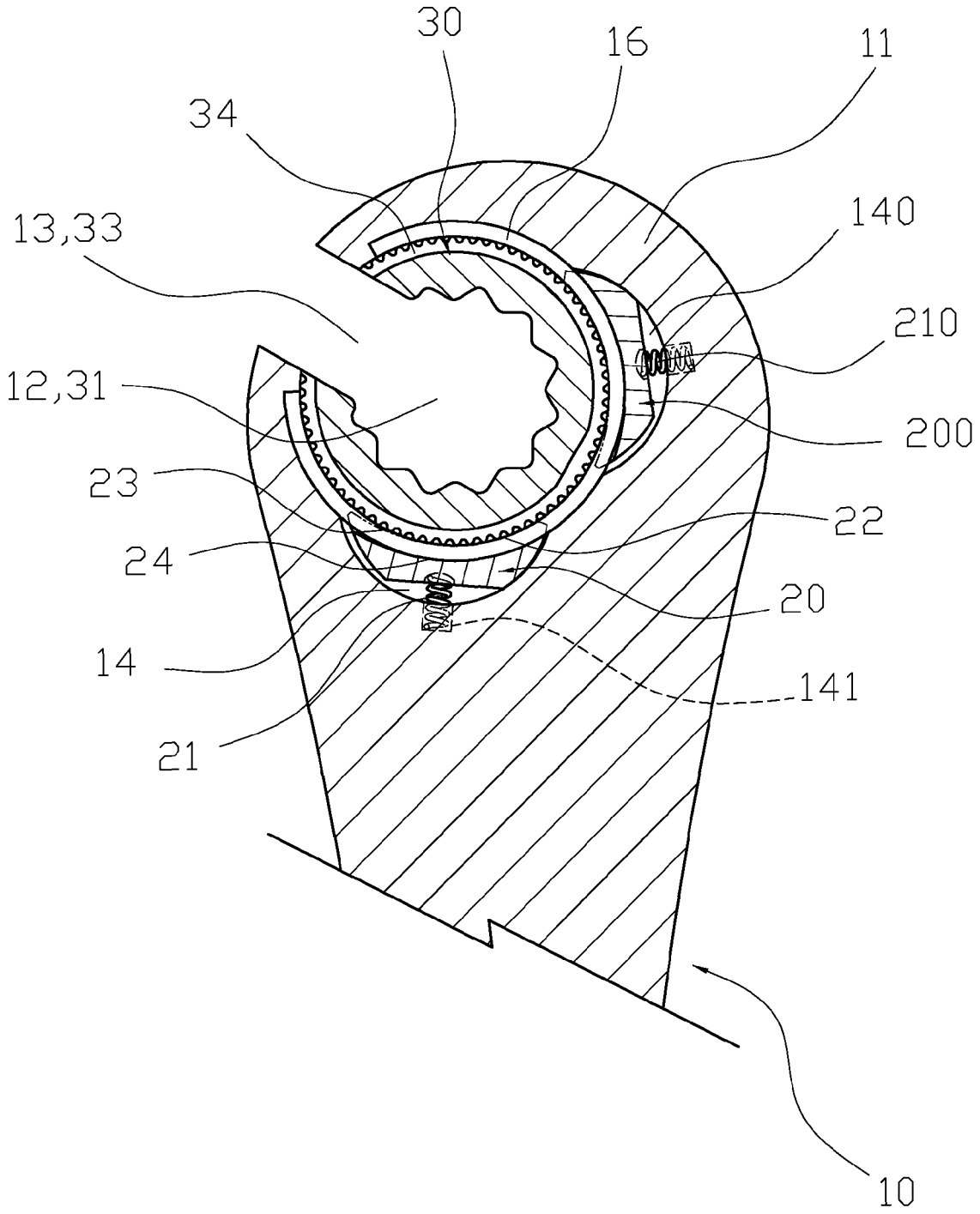
FIG. 8 is a cross-sectional view of another embodiment of the present invention.

For another embodiment of the present invention, please refer to FIG. 8. The receptacle 14 includes the control member 20, and a second receptacle 140 is set in the inner wall of the first aperture 12. The second receptacle 140 is used for accepting a second control member 200, and a second elastic member 210 is sandwiched between the second control member 200 and the second receptacle 140. Therefore, the ratchet 30 has more application points to increase the applied torque of the ratchet wrench.

Although the present invention has been explained in relation to its preferred embodiment, it is to be understood that many other possible modifications and variations can be made without departing from the spirit and scope of the invention as hereinafter claimed.

What is claimed is:

1. A combination open-ended ratcheting wrench with a box-end wrench, the combination open-ended ratcheting wrench comprising:

a wrench having a wrench head, the wrench head having a first aperture with a first opening, a receptacle formed at an inner wall of the first aperture, at least one limiting groove disposed around the inner wall of the first aperture and connected to the receptacle, the limiting groove having internal limiting members;

a control member pushing against an elastic member acceptable in the receptacle and having a ratcheting surface and a smooth surface facing outward, and at least one stopping edge corresponding to and accepting the limiting members;

a ratchet disposed in the first aperture and having a ratcheting aperture, the ratcheting aperture having a ratchet opening, a ratcheting pawl formed around an outer circumference of the ratchet and corresponding to the ratcheting surface of the control member; and a rotation cap disposed on the wrench head covering a portion of the ratchet in the first aperture and having a second opening corresponding to the first aperture.

2. The combination open-ended ratcheting wrench with a box-end wrench as claimed in claim 1, wherein the receptacle has a first hole disposed at a bottom surface, and the control member has a second hole facing the receptacle such that the elastic member is placed in the first hole and the second hole to provide a limiting effect.

3. The combination open-ended ratcheting wrench with a box-end wrench as claimed in claim 1, wherein the first aperture further has a first assembling groove and a second assembling groove respectively disposed on both sides of the limiting groove.

4. The combination open-ended ratcheting wrench with a box-end wrench as claimed in claim 1, wherein the ratchet has a first positioning groove adjacent to the ratcheting pawl corresponding to the first assembling groove, and a first C-shaped hook is sandwiched between the first assembling groove and the first positioning groove such that the rotation cap is capable of rotating in the wrench head.

5. The combination open-ended ratcheting wrench with a box-end wrench as claimed in claim 1, wherein the rotation cap further comprises a second positioning groove corresponding to the second assembling groove, and a second C-shaped hook is sandwiched between the second assembling groove and the second positioning groove such that the rotation cap is capable of rotating in the wrench head.

6. The combination open-ended ratcheting wrench with a box-end wrench as claimed in claim 1, wherein the limiting member is a C-shaped ring.

7. The combination open-ended ratcheting wrench with a box-end wrench as claimed in claim 1, wherein the rotation cap has a flanged portion as a larger end and a connecting end as a smaller end, the connecting end jacketed onto an end of the ratcheting pawl of the ratchet and having a coupling segment extending from an inner wall of the connecting end, the coupling segment matching a coupling beveled corner formed at the end of the ratcheting pawl, such that the rotation cap is coupled to the ratchet.

8. The combination open-ended ratcheting wrench with a box-end wrench as claimed in claim 7, wherein the rotation cap has a roughened edge around the circumference of the flanged portion.

9. The combination open-ended ratcheting wrench with a box-end wrench as claimed in claim 1, wherein the ratchet has a stopping ring at an enlarged end, and a roughened surface is formed along an outer edge of the stopping ring.

10. The combination open-ended ratcheting wrench with a box-end wrench as claimed in claim 1, wherein the elastic member is a circular spring.

11. The combination open-ended ratcheting wrench with a box-end wrench as claimed in claim 1, wherein the elastic member is a sheet spring.

12. The combination open-ended ratcheting wrench with a box-end wrench as claimed in claim 1, wherein the elastic member is formed of rubber.

13. The combination open-ended ratcheting wrench with a box-end wrench as claimed in claim 1, wherein the first opening, the ratchet opening and the second opening are identically sized openings and are capable of alignment with each other.

14. The combination open-ended ratcheting wrench with a box-end wrench as claimed in claim 1, wherein the inner wall of the first aperture further comprises a second receptacle, and the second receptacle is used for accepting a second control member.

15. The combination open-ended ratcheting wrench with a box-end wrench as claimed in claim 14, wherein a second elastic member is sandwiched between the second control member and the second receptacle.

16. The combination open-ended ratcheting wrench with a box-end wrench as claimed in claim 1, wherein the first aperture has two limiting grooves at both ends of the receptacle, the limiting members disposed in the limiting grooves, and the control member has two stopping edges corresponding to the limiting members at the ratcheting surface.

* * * * *